US006145487A

United States Patent [19]

Dykstra et al.

[11] Patent Number: 6,145,487

[45] Date of Patent: Nov. 14, 2000

[54] AUTOMATIC AIR INLET CONTROL SYSTEM FOR AN ENGINE

[75] Inventors: Richard A. Dykstra, Cedar Grove; Robert K. Mitchell, Brookfield, both of Wis.

[73] Assignee: Briggs and Stratton Corporation, Wis.

[21] Appl. No.: 09/466,817

[22] Filed: Dec. 17, 1999

Related U.S. Application Data

[62] Division of application No. 09/001,178, Dec. 30, 1997, Pat. No. 6,012,420.

[51] Int. Cl.[7] ..... F02M 1/10

[52] U.S. Cl. ..... 123/179.18; 261/39.2

[58] Field of Search ..... 123/179.18, 179.16, 123/437; 261/39.1, 39.2, 39.3

[56] References Cited

U.S. PATENT DOCUMENTS

| | | | |
|---|---|---|---|
| 1,969,358 | 8/1934 | Coffelder | 261/52 |
| 2,362,346 | 11/1944 | Blake | 123/119 |
| 2,533,551 | 12/1950 | Boyce | 261/39 |
| 2,548,334 | 4/1951 | Armstrong | 123/119 |
| 2,836,159 | 5/1958 | Morden | 123/103 |
| 3,104,657 | 9/1963 | Rice | 123/103 |
| 3,161,186 | 12/1964 | Reichenbach et al. | 123/119 |
| 3,650,252 | 3/1972 | Glover et al. | 123/103 B |
| 3,749,069 | 7/1973 | Reese | 123/108 |
| 3,788,289 | 1/1974 | Pfister | 123/103 B |
| 3,831,567 | 8/1974 | Freismuth et al. | 123/119 |
| 3,863,614 | 2/1975 | Thompson et al. | 123/119 |
| 3,970,059 | 7/1976 | Pisar | 123/103 B |
| 4,026,280 | 5/1977 | Iiyama et al. | 123/119 F |
| 4,031,872 | 6/1977 | Thompson et al. | 123/119 |
| 4,297,980 | 11/1981 | Bellis | 123/438 |
| 4,298,549 | 11/1981 | Woodworth | 261/39 B |
| 4,672,929 | 6/1987 | Wissmann et al. | 123/179 G |
| 4,788,014 | 11/1988 | Kanno | 261/39.2 |
| 4,948,536 | 8/1990 | Scott et al. | 261/64.4 |
| 5,025,627 | 6/1991 | Schneider | 60/527 |
| 5,069,180 | 12/1991 | Schmidt et al. | 123/376 |
| 5,177,969 | 1/1993 | Schneider | 60/527 |
| 5,419,133 | 5/1995 | Schneider | 60/527 |
| 5,503,125 | 4/1996 | Gund | 123/392 |
| 5,511,519 | 4/1996 | Watson et al. | 123/179.18 |

OTHER PUBLICATIONS

"Thermally—and Phase Transformation–Induced Volume Changes of Polymers for Actuator Applications" by B.Z. Jang and Z.J. Zhang, published in the *Proceedings of the Second International Conference on Intelligent Materials*, Technomic Publishing Company, Inc., Jun. 1994, pp. 654–664.

"Hoechst Actuating Polymers–Material Performance Data" published by Hoechst Celanese at least as early as Apr. 1996.

*Primary Examiner*—Andrew M. Dolinar
*Attorney, Agent, or Firm*—Michael Best & Friedrich LLP

[57] ABSTRACT

An automatic choke for a small internal combustion engine uses an air vane responsive to an air flow created by a radial fan to position the choke valve during engine starting. A return spring or gravity may be used to reset the automatic choke after the engine has been stopped. The automatic choke includes a thermally-responsive device that keeps the choke at least partially open during hot restarts of the engine.

9 Claims, 7 Drawing Sheets

FIG. 1
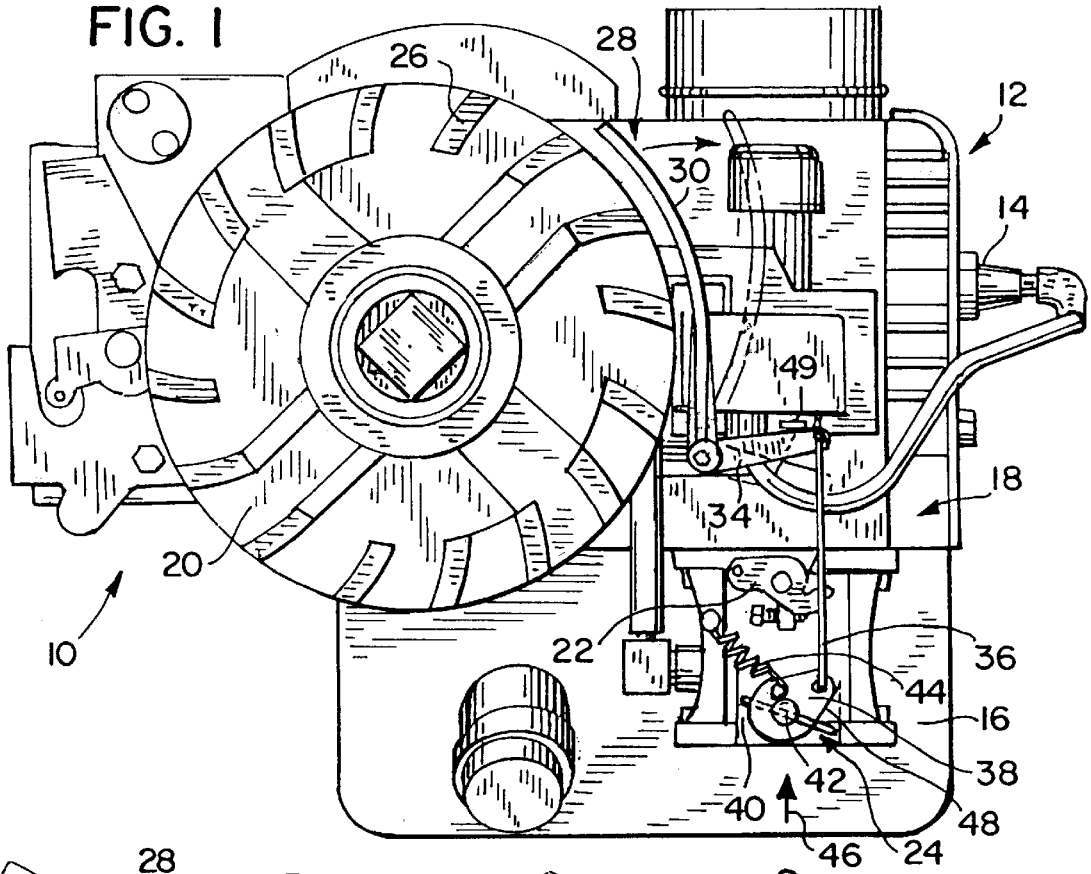
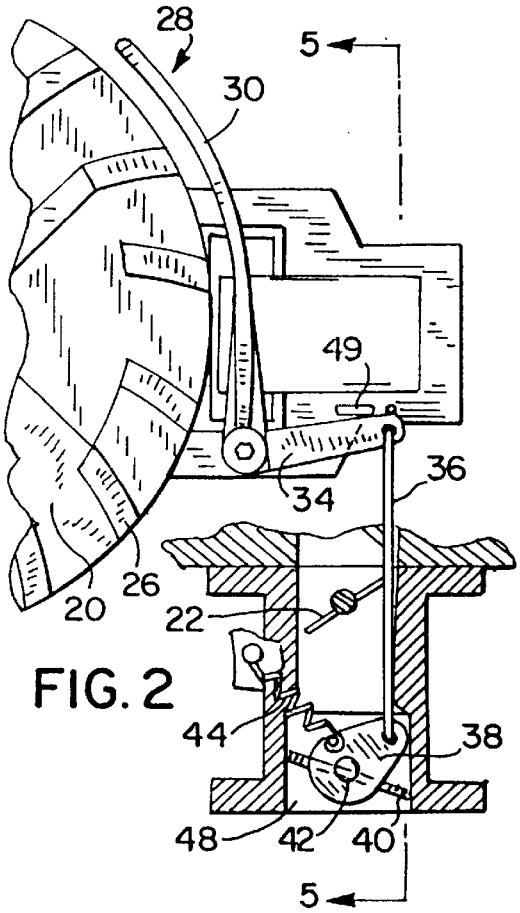
FIG. 2
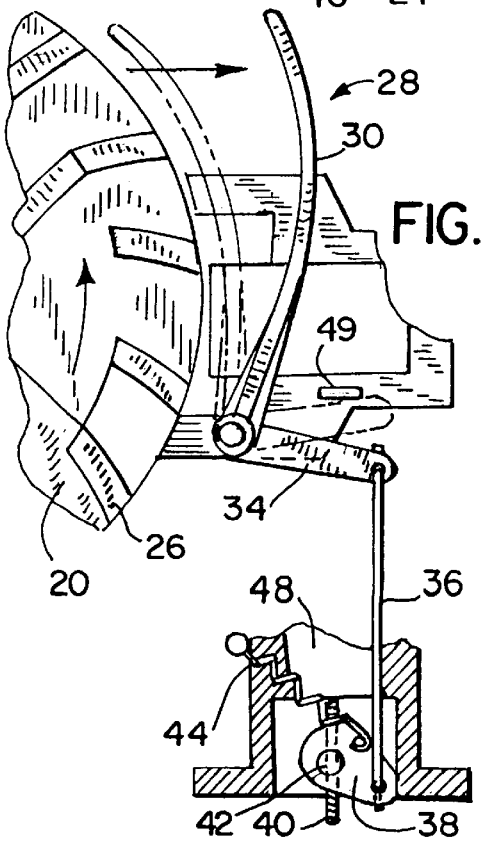
FIG. 3

FIG. 4
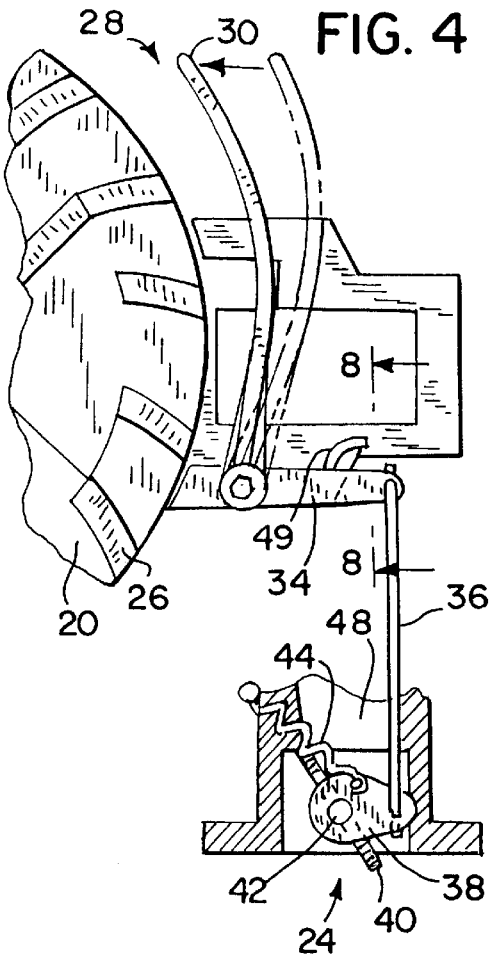
FIG. 8
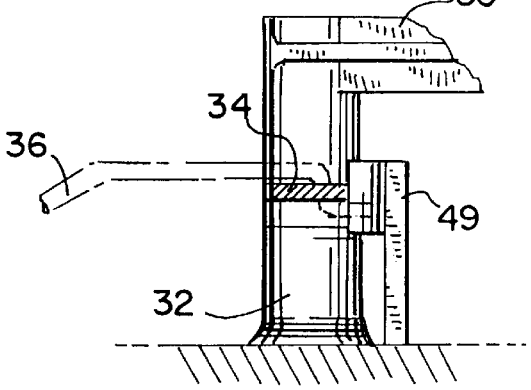
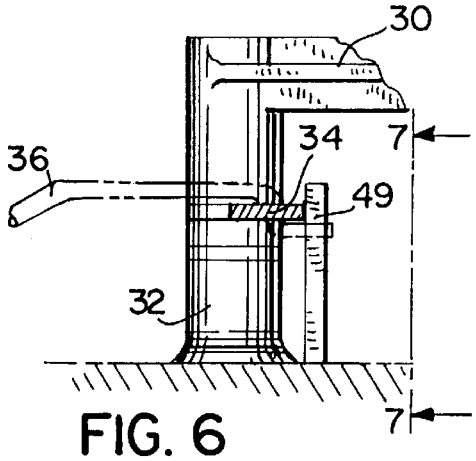
FIG. 6
FIG. 5
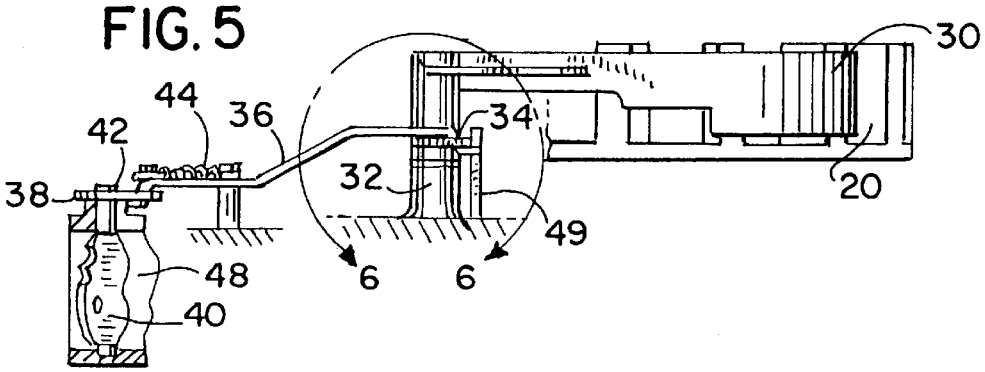
FIG. 7
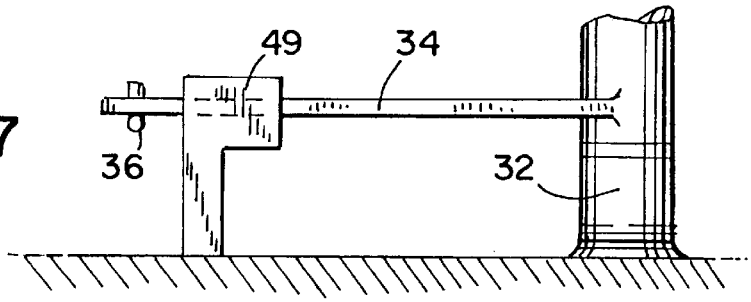

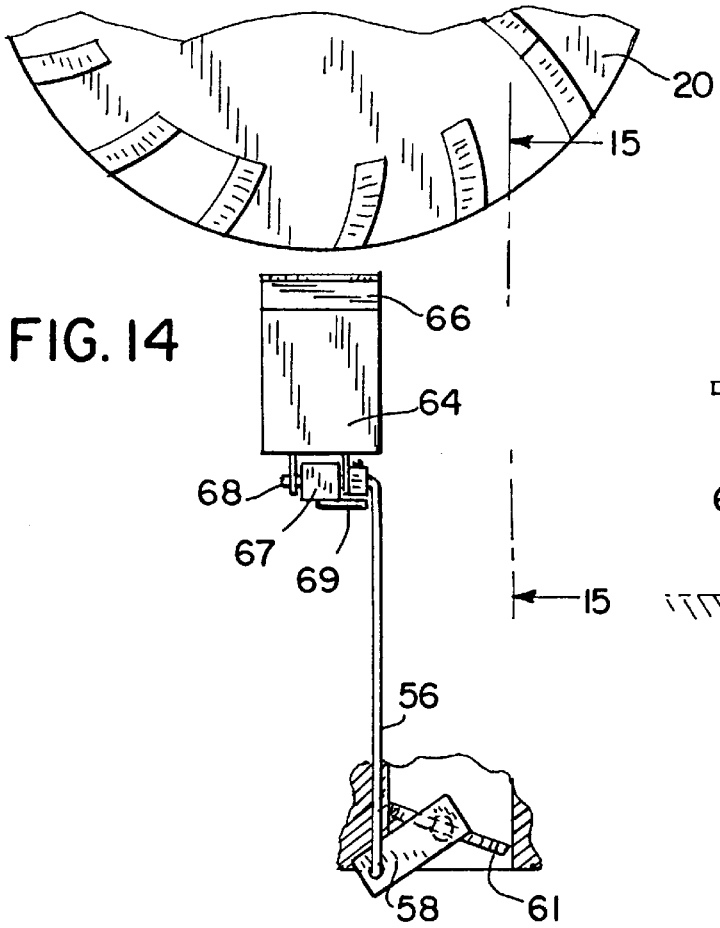
FIG. 14
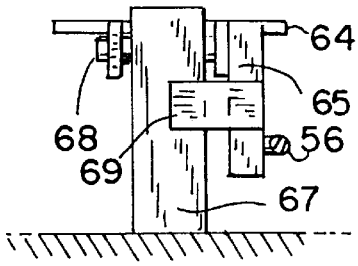
FIG. 16
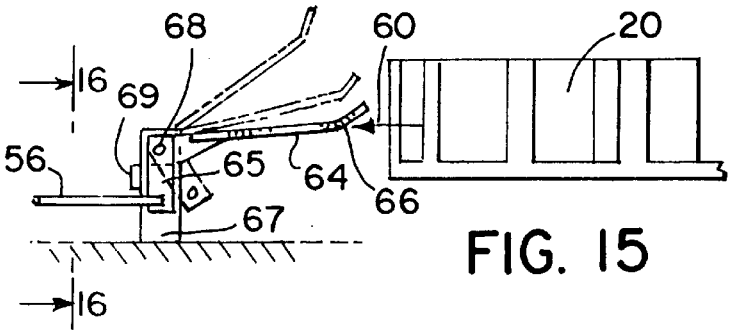
FIG. 15
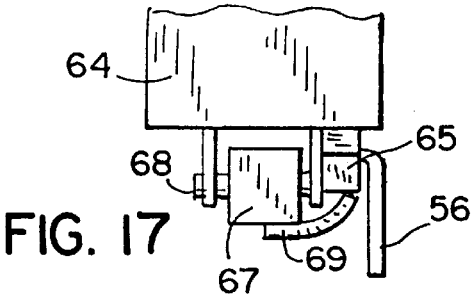
FIG. 17
FIG. 18
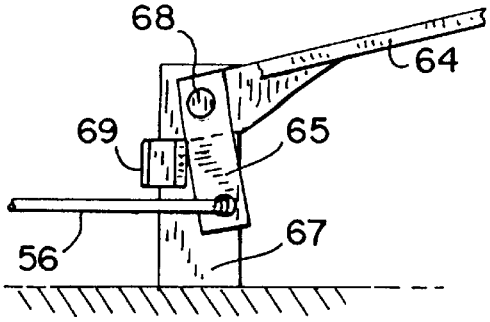

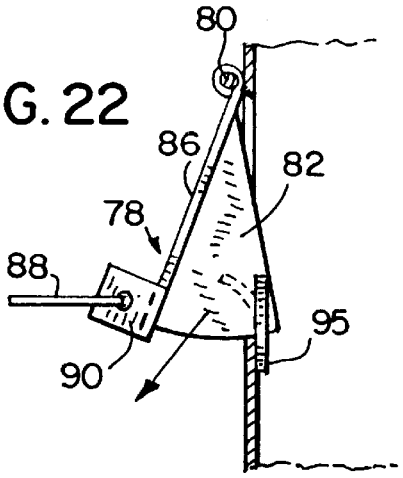
FIG. 22
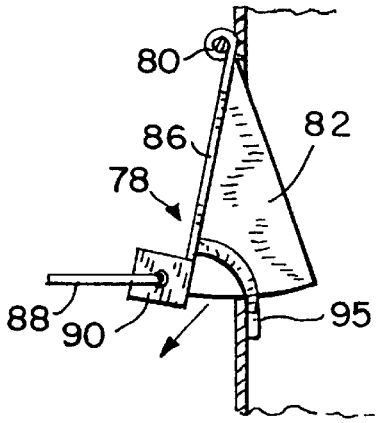
FIG. 23
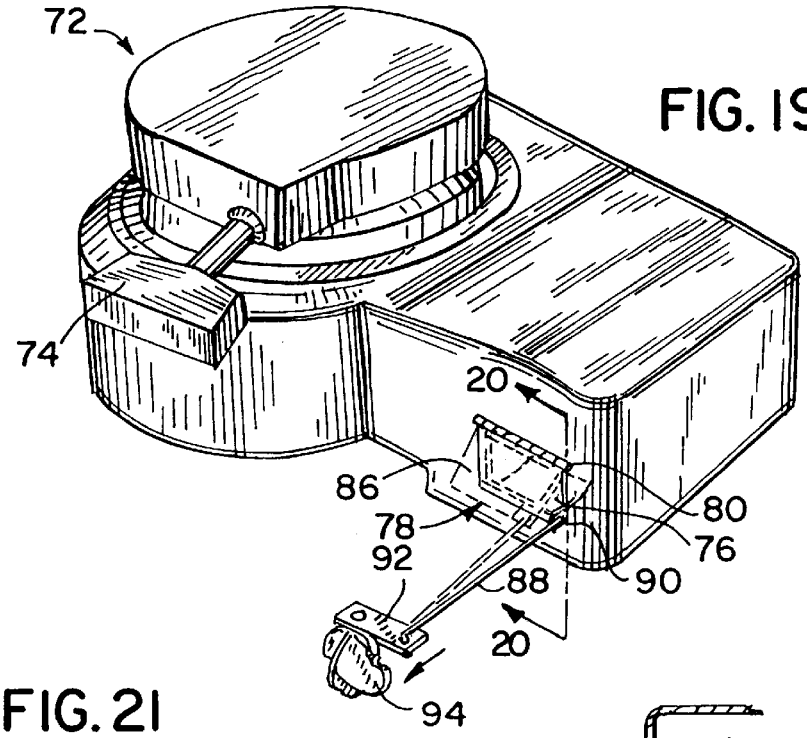
FIG. 19
FIG. 21
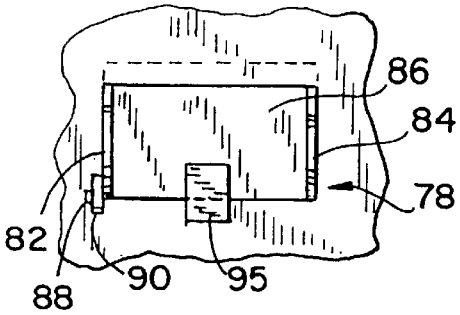
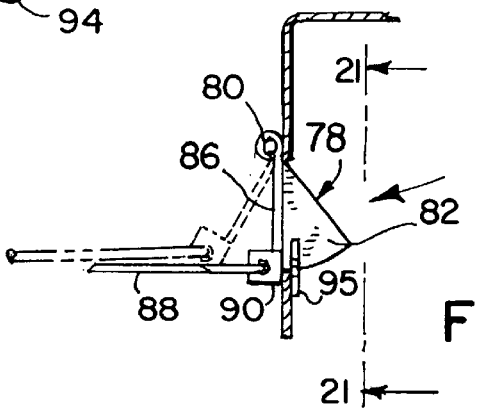
FIG. 20

FIG. 24
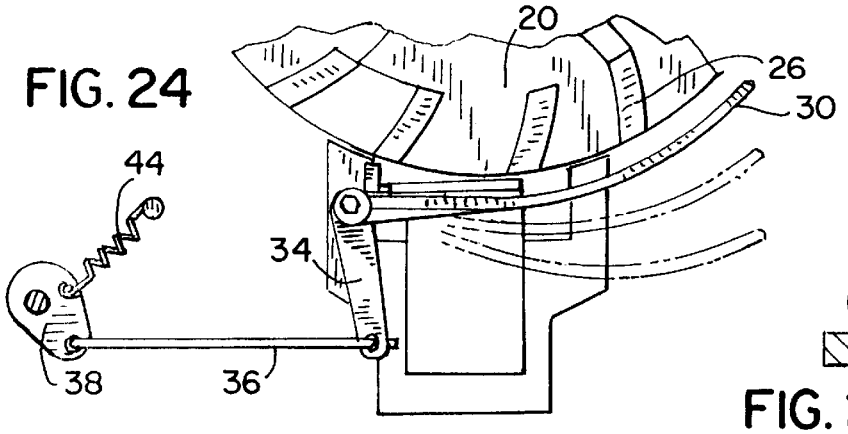
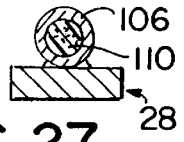
FIG. 27
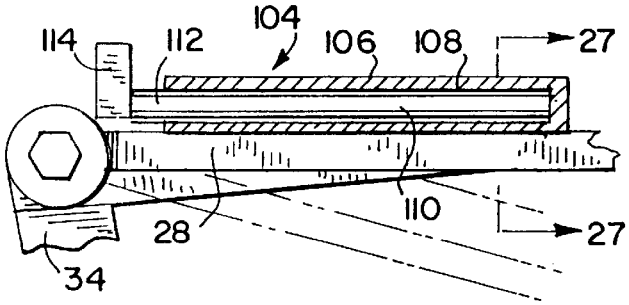
FIG. 25
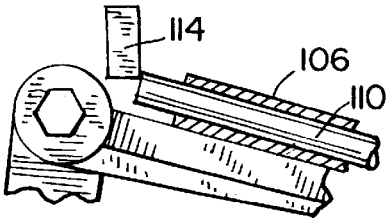
FIG. 26
FIG. 28
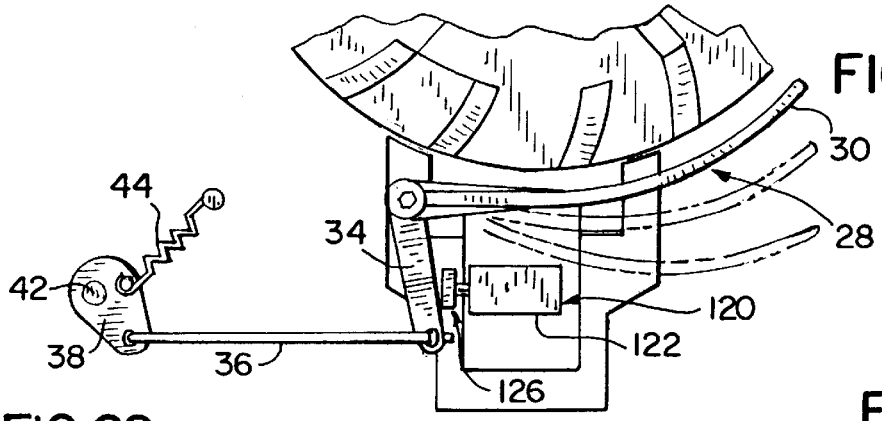
FIG. 29
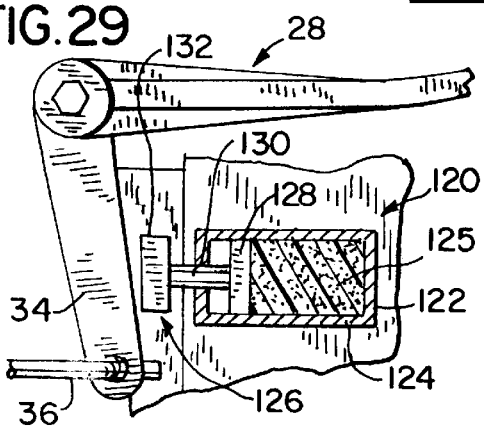
FIG. 30
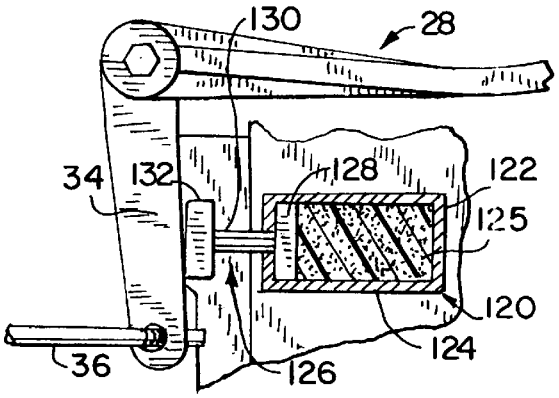

FIG. 31
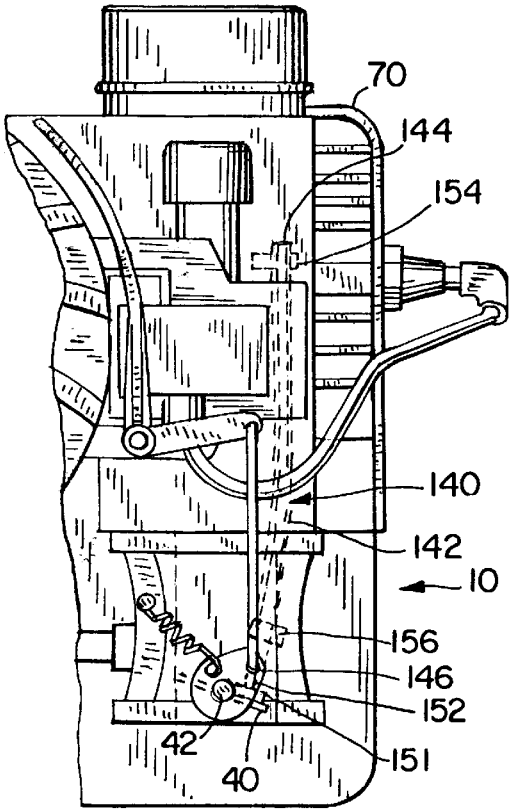
FIG. 32
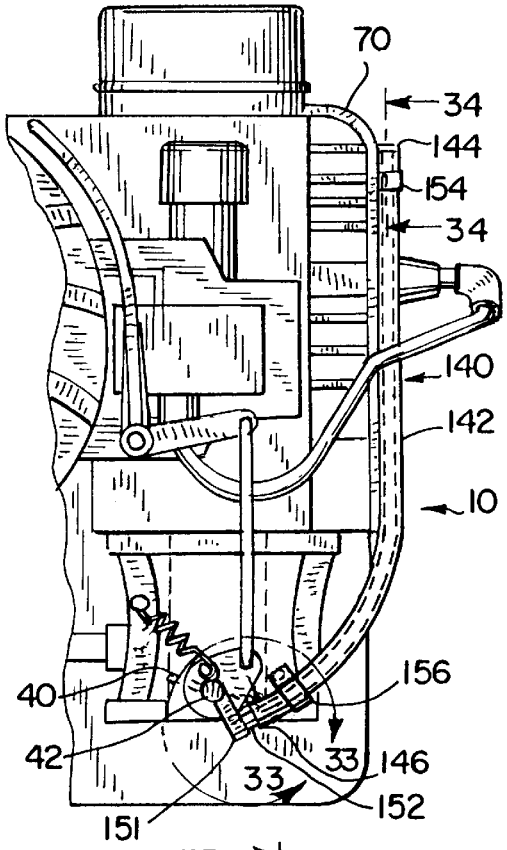
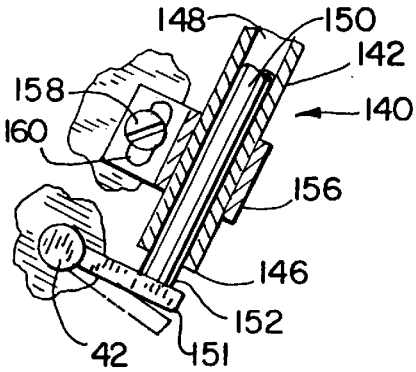
FIG. 33
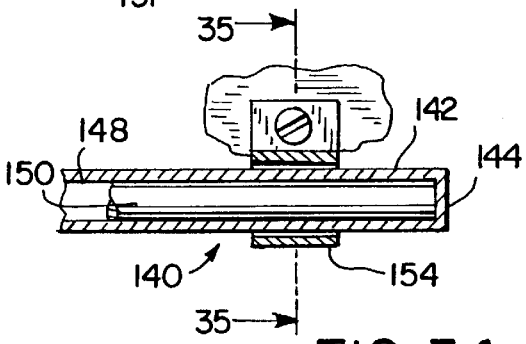
FIG. 34
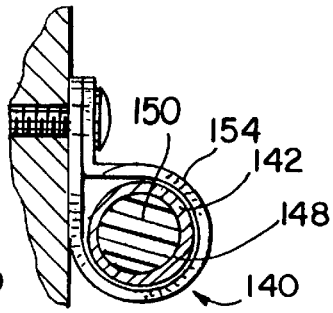
FIG. 35

AUTOMATIC AIR INLET CONTROL SYSTEM FOR AN ENGINE

This application is a divisional of U.S. Pat. application Ser. No. 09/001,178, filed Dec. 30, 1997, now U.S. Pat. No. 6,012,420.

BACKGROUND OF THE INVENTION

This invention relates to an automatic air inlet system, such as a choke, for an internal combustion engine. More particularly, this invention relates to an inlet control system that is responsive to an engine air flow.

It is known to use a manually-operable starting device to assist in starting of a small internal combustion engine. Typical manual starting devices include a primer or a choke, which may be used together in some applications. A primer typically provides a charge of fuel before the engine is started to assist in starting, particularly at lower temperatures. A choke valve is typically positioned in the air intake passageway, and reduces the amount of intake air to thereby enrichen the air/fuel mixture during engine starting.

A major disadvantage of such prior art starting devices is that they must be manually operated by the user in the correct manner for them to be effective. With a manual choke, for example, the operator must typically move a choke lever into the appropriate choke position, start the engine, and then quickly move the choke lever to the disengaged position. The choke lever must be moved to the disengaged position once the engine has started to prevent the engine from stumbling or stalling.

Automatic chokes are known for use with internal combustion engines. Such chokes are typically microprocessor-controlled, are complicated and are expensive. The expense of such microprocessor-controlled automatic chokes will typically make such chokes impractical for use on a small, relatively inexpensive internal combustion engine.

There are several problems in attempting to design an inexpensive automatic choke for an engine. One problem is that the choke must automatically disengage at an appropriate point to keep the engine from stumbling or stalling after it has started. A second problem is that the choke should be disengaged during hot restarts of the engine, while at the same time being automatically engaged during starting of a cold engine. It is desirable to disengage the choke during hot restarts to prevent stumbling or stalling of the engine when the engine is already warmed up, and to reduce the amount of unburnt fuel and noxious exhaust emissions during hot restarts.

An automatic choke is known that is operable using the air flow from an air vane. In U.S. Pat. Nos. 3,863,614 issued Feb. 4, 1975 and 4,031,872 issued Jun. 28, 1977, an automatic choke is disclosed that uses an air vane, and has two oppositely-wound bimetallic coils to control the influence of the air vane. One of the coils keeps the choke open during hot restarts of the engine. However, this apparatus is complicated and expensive, and may not be feasible for a small, relatively inexpensive internal combustion engine. An automatic choke using an air vane is also disclosed in U.S. Pat. No. 5,503,125. It has a two spring linkage which controls the air vane at no load and light load conditions. However, the device provides no structure to keep the vane open for hot restarts.

SUMMARY OF THE INVENTION

The invention includes an automatic choke apparatus for an internal combustion engine that automatically engages during cold restarts of the engine, but that retains the choke valve at least partially open during hot restarts.

In one aspect, the invention includes a device that creates an air flow as a function of the engine speed, such as a radial fan, and a vane that is movable in response to the air flow and that substantially returns to a rest position when the air flow is below a predetermined level. The vane is connected to a choke valve by a linkage such that the choke valve is substantially closed after the engine has stopped, and such that the choke valve is substantially open when the engine is at operating speeds.

The invention also includes a novel, inexpensive assembly that retains the choke valve at least partially open during hot restarts of the engine. This assembly includes an abutment surface interconnected with the engine, and a thermally-responsive device that engages the abutment surface when the temperature near the thermally-responsive device is above a predetermined level. As a result, the linkage or vane is partially displaced during hot restarts of the engine, thereby retaining the choke valve in a partially open position during starting of the engine when the temperature near the thermally-responsive device is above the predetermined actuation temperature of the thermally-responsive device.

Several different configurations of the vane are disclosed. In one configuration, the vane has a paddle shaped like a segmented cylinder that moves substantially radially in response to the air flow from the fan. In another configuration, the paddle has a shape like an air foil that moves substantially in the axial direction with respect to the axis of fan rotation. In yet another configuration, the vane has a lift flange that catches some of the air flow and moves the vane in the axial direction.

In another aspect, the invention is an intake air control system for an engine that includes a device which creates an air flow as a function of the engine speed, a vane that is movable in response to the air flow, an air inlet valve interconnected with the vane and movable in response to the movement of the vane, and a thermally-responsive device in response to which the valve is retained in a partially open position during engine starting when the engine is warm. This air intake control system insures that the inlet valve is substantially closed to enrichen the air/fuel mixture during cold engine starts, but that the choke valve is at least partially open during hot restarts of the engine.

The thermally-responsive device may have several configurations. In one configuration, the abutment surface is disposed on at least one of the vane and the linkage, and the thermally-responsive device includes a bimetallic member, interconnected with the engine, that engages the abutment surface when the temperature near the bimetallic member is above its predetermined actuation temperature so that the choke is retained in a partially open position during starting of the engine when the temperature near the bimetallic member is above its actuation temperature during engine starting.

In another configuration, the thermally-responsive device includes a thermally-responsive member, interconnected with at least one of the vane and the linkage, that has either a high coefficient of thermal contraction or a high coefficient of thermal expansion at engine operating temperatures so that the choke is retained in a partially open position during hot restarts of the engine. The thermally-responsive member may include an assembly having a housing and a thermal actuating polymer or wax therein that expands at engine operating temperatures and that abuts the abutment surface to keep the inlet valve at least partially open during hot restarts.

In another configuration, the thermally-responsive device includes a thermally-responsive material, such as a wax or a polymer, substantially contained within a housing. The housing is mounted on the engine. The material has either a high coefficient of thermal contraction or a high coefficient of thermal expansion at engine operating temperatures so that the choke is retained in a partially open position during hot restarts of the engine. The thermally-responsive material may include an assembly having a housing, a thermal actuating polymer or wax therein that expands at engine operating temperatures, a piston-like device that engages the material within the housing on one end and that engages and actuates a lever arm, with a second end outside of the housing, to keep the inlet valve at least partially open during hot restarts.

It is a feature and advantage of the present invention to provide an automatic air inlet control system that is inexpensive and that does not require microprocessor control.

It is yet another feature and advantage of the present invention to provide an automatic inlet air control system that resets before a cold starting of the engine, but that keeps the inlet valve at least partially open during hot restarts of the engine.

It is yet another feature and advantage of the present invention to provide an automatic choke that uses the air flow from a fan or similar device to control the position of the choke.

These and other features of the present invention will be apparent to those skilled in the art from the following detailed description of the invention, in which:

BRIEF DESCRIPTION OF THE DRAWINGS

FIG. 1 is a top view of an engine incorporating a first embodiment of the present invention.

FIG. 2 is a partial top view of the first embodiment when the engine is cold and at rest.

FIG. 3 is a partial top view of the first embodiment when the engine is at an operating speed.

FIG. 4 is a top view of the first embodiment when the engine is hot and at rest.

FIG. 5 is a cross-sectional side view of the first embodiment, taken along line 5—5 of FIG. 2.

FIG. 6 is an enlarged side view of the first embodiment, taken from the area encircled by line 6—6 of FIG. 5, when the engine is cold and at rest.

FIG. 7 is an end view of the first embodiment, taken along line 7—7 of FIG. 6.

FIG. 8 is an enlarged side view of the first embodiment similar to FIG. 6 except that the engine is hot and at rest.

FIG. 14 is a partial top view of a third embodiment of the present invention.

FIG. 15 is a partial side view of the third embodiment, taken along line 15—15 of FIG. 14.

FIG. 16 is an end view of the third embodiment taken along line 16—16 of FIG. 15.

FIG. 17 is an enlarged partial top view of the third embodiment when the engine is hot and at rest.

FIG. 18 is an enlarged partial side view of the third embodiment when the engine is hot and at rest.

FIG. 19 is a perspective view of an engine blower housing incorporating a fourth embodiment of the present invention.

FIG. 20 is an enlarged partial side view of the fourth embodiment, when the engine is cold, taken along line 20—20 of FIG. 19.

FIG. 21 is a partial end view of the fourth embodiment, taken along line 21—21 of FIG. 20.

FIG. 22 is an enlarged partial side view of the fourth embodiment, when the engine is running, taken along the line 20—20 of FIG. 19.

FIG. 23 is an enlarged partial side view of the fourth embodiment similar to FIG. 20 except that the engine is hot and at rest.

FIG. 24 is a partial top view of a fifth embodiment incorporating a different thermally-responsive device, when the engine is cold and in the stopped position.

FIG. 25 is an enlarged partial top view of the thermally-responsive device of FIG. 24, when the engine is cold and in the stopped position.

FIG. 26 is an enlarged partial top view of the thermally-responsive device of FIG. 24, when the engine is hot and either stopped or just started.

FIG. 27 is a cross-sectional end view, taken along line 27—27 of FIG. 25, of the thermally responsive device and the vane.

FIG. 28 is a partial top view of a sixth embodiment incorporating a thermally-responsive piston device.

FIG. 29 is an enlarged top view of the thermally-responsive device shown in FIG. 28, when the engine is cold and stopped.

FIG. 30 is an enlarged top view of the thermally-responsive device shown in FIG. 28, when the engine is hot and stopped.

FIG. 31 is a partial top view of a seventh embodiment when the engine is cold and stopped, in which the thermally-responsive device is disposed under the blower housing.

FIG. 32 is a partial top view of an eighth embodiment when the engine is cold and stopped, in which the thermally-responsive device is disposed adjacent the engine cylinder.

FIG. 33 is an enlarged top view of the eighth embodiment, taken from the area encircled by line 33—33 of FIG. 32, when the engine is cold and at rest.

FIG. 34 is a cross-sectional side view, taken along line 34—34 of FIG. 32, of an end of the thermally responsive device and a clamp.

FIG. 35 is a cross-sectional end view, taken along line 35—35 of FIG. 34 of the thermally responsive device and a clamp.

DETAILED DESCRIPTION OF THE INVENTION

Figure 12:
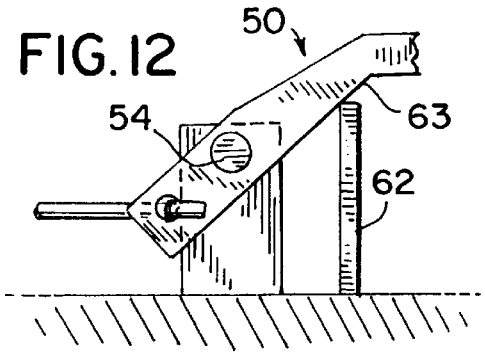
FIG. 12 is an enlarged side view, taken of the area encircled by line 12—12 of FIG. 10, when the engine is cold and at rest.

FIG. 1 is a top view of an engine incorporating the first embodiment of the invention. In FIG. 1, engine 10 includes a cylinder 12, a spark plug housing 14, a fuel tank 16, a carburetor 18, and a rotatable fan 20, preferably of the radial-type. Carburetor 18 includes a throttle valve 22 and a choke valve assembly 24. Radial fan 20 includes a plurality of spaced radially-extending blades 26 which, upon rotation of fan 20, create an air flow that is used to operate the present invention.

In FIG. 1, the present invention also includes an air vane 28 having a paddle 30 that is pivotally mounted to a support 32 (FIG. 5). Vane 28 is interconnected with a lever arm 34 which in turn is connected to a link arm 36. Link arm 36 engages a choke lever arm 38 that pivots choke valve 40 about a shaft 42. Spring 44 tends to rotate choke lever arm 38 so that choke valve 40 is at least partially closed after the engine has been stopped. As shown in FIG. 1, intake air, represented by arrow 46, flows past valve 40 and is received in intake passageway 48.

As shown in FIG. 1, paddle 30 is positioned relatively close to fan 20 when the engine is at rest, since there is little air flow developed by the fan. Paddle 30 moves radially outward, as shown in phantom in FIG. 1, at engine operating speeds due to the air flow developed by rotating fan 20.

FIG. 1 also depicts a thermally-responsive plate 49, which is preferably a bimetallic disk or plate. The bimetallic disk is composed of two pieces of metal having different coefficients of thermal expansion. Plate 49, shown in FIG. 1, is in a position corresponding to a relatively cold engine temperature. Plate 49 is located adjacent to lever arm or abutment surface 34, shown in FIGS. 1, 2, and 6. Plate 49 is made of a thermally-responsive material that deforms at a predetermined temperature. When plate 49 deforms it engages and actuates lever arm 34, as shown in FIGS. 4 and 8. Thus, when the engine temperature is warm, plate 49 deforms and actuates lever arm 34 when the engine is stopped. This has the effect of at least partially opening choke valve 40 so that an overly enriched air/fuel mixture is not supplied to the engine during a hot restart. An overly enriched air/fuel mixture supplied to the engine when hot may cause stumbling or stalling of the engine and increased noxious exhaust emissions.

When the engine cools down after the engine has been stopped for a period of time, thermally-responsive plate 49 will snap to the cold position depicted in FIG. 6. The bimetallic disk or snap plate is preferably set to snap at about 90°–110° Fahrenheit, with a tolerance of plus or minus 5° Fahrenheit. At elevated temperatures, the choke valve is sufficiently open for the engine to start and to accelerate during a hot restart of the engine. Due to hysteresis in the bimetallic plate, and if we assume that the switching point is 110° Fahrenheit, the reset point would be about 70°–90° Fahrenheit. One suitable snap plate is made by Precision Controls Inc. of Ann Arbor, Mich.

FIGS. 2, 3, and 6 depict the first embodiment of the engine when the engine is cold and at rest (FIGS. 2 and 6), and cold and at engine operating speeds (FIG. 3). Referring to FIG. 2, when the engine is at rest or operating at a very low speed during starting, the position of paddle 30 causes lever arm 34 to pivot, thereby moving link arm 36 and choke lever arm 38 such that the choke valve 40 is in a substantially closed position. As a result, the air/fuel mixture is enrichened to increase startability of the engine.

As shown in FIG. 3, paddle 30 is moved radially outward away from fan 20 (FIG. 1), thereby pivoting lever arm 34. As a result, link arm 36 and choke lever arm 38 move choke valve 40 to a substantially open position so that the intake air flow is not impeded at engine operating speeds.

FIG. 4 depicts the first embodiment of the invention when the engine is either warm and at rest or warm and at a very low speed. Because the engine is warm, plate 49 is deformed and abuts lever arm 34, which moves link 36 and at least partially opens choke valve 40. As a result, the air/fuel mixture provided to the engine is leaner than when choke valve 40 is fully closed.

FIG. 7 depicts a possible shape for plate 49, but it should be noted that the invention is not limited to this shape. Other shapes for plate 49 can be used if they deform and are able to actuate lever arm 34 when the predetermined temperature is reached.

As shown by the side view in FIG. 5, paddle 30 has a substantial width to pick up a significant portion of the air flow generated by fins 26 as fan 20 rotates.

Figure 9:
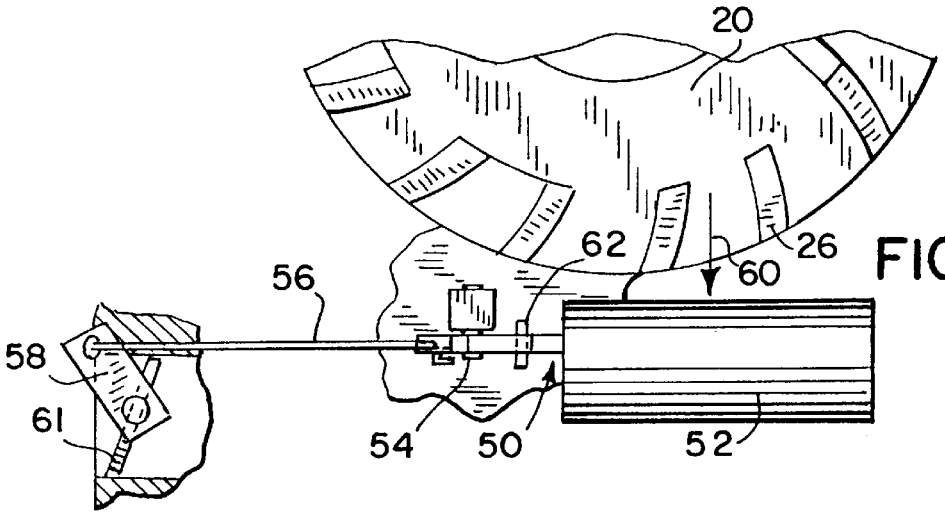
FIG. 9 is a partial top view of a second embodiment of the present invention.
Figure 10:
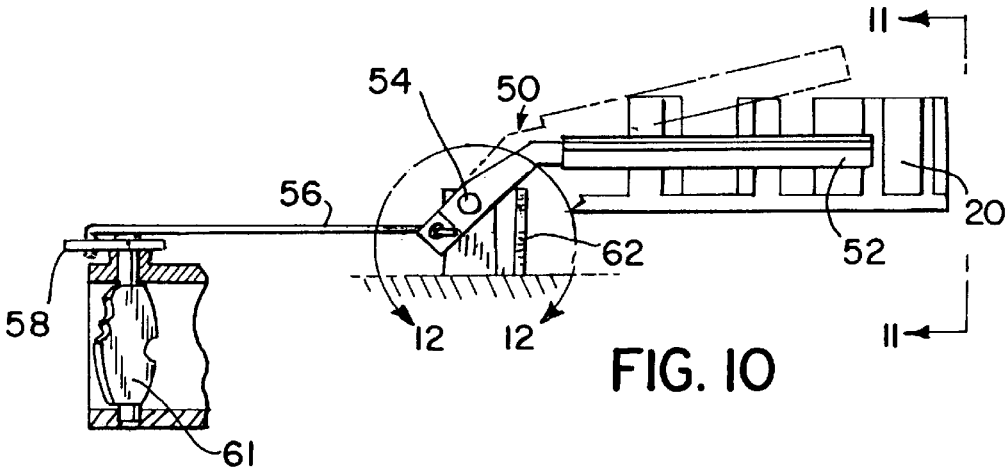
FIG. 10 is a side view of the second embodiment.
Figure 11:
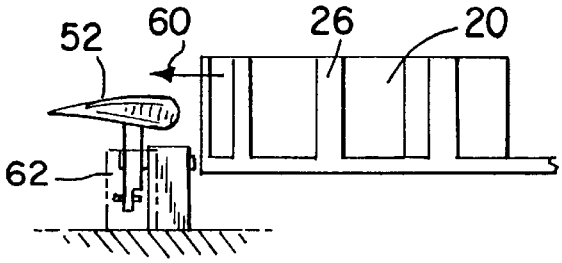
FIG. 11 is an end view of the second embodiment, taken along line 11—11 of FIG. 10.

FIGS. 9 through 13 depict a second embodiment of the present invention. In FIGS. 9 through 11, vane 50 has a paddle 52 that is shaped like an air foil, as best shown in FIG. 11. Paddle 52 is disposed generally tangential to the circumference of fan 20.

As best shown in FIGS. 10 and 11, the air flow from fan 20 will cause paddle 52 to pivot about a pivot 54 such that the paddle moves in an arc having a segment that is generally parallel to the axis of rotation of fan 20 as the engine speed reaches an operating speed. As a result, link arm 56 pivots choke lever arm 58 to thereby substantially open the choke at engine operating speeds. When the engine is cold and either at rest or during engine starting, vane 52 is in the position depicted in solid lines in FIG. 10. At these speeds, the air flow, depicted by arrows 60 (FIGS. 9 and 11), is insufficient to lift vane 52; as a result, choke valve 61 remains substantially closed.

Figure 13:
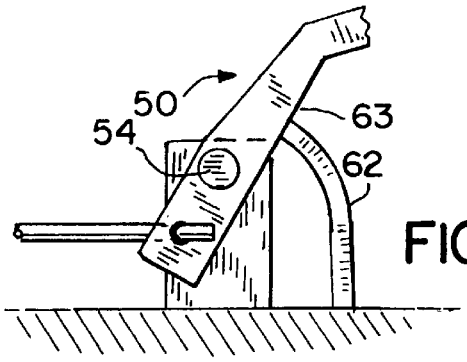
FIG. 13 is an enlarged side view similar to FIG. 12 except that the engine is hot and at rest.

FIGS. 9 through 13 also depict a thermally-responsive plate 62 adjacent to a pivot 54 and vane 50. Plate 62 deforms when the engine temperature is warm. FIGS. 9 through 12 depict plate 62 in a state corresponding to a substantially cold engine temperature. FIG. 13 depicts plate 62 in a state corresponding to a warm engine temperature. In the warm state, plate 62 is deformed and engages a substantially diagonal lever surface or abutment surface 63. When plate 62 deforms and engages surface 63, vane 50 rotates about pivot 54, moving link 56 and thereby at least partially opening choke valve 61. In this position the choke valve is at least partially open, providing air flow to the carburetor for a hot restart of the engine.

FIGS. 14 through 18 depict a third embodiment of the invention that is similar to the embodiment of FIGS. 9 through 13. In FIGS. 14 and 15, paddle 64 includes a lift flange 66 that is positioned on support 67 to pick up air flow 60 from rotating fan 20. At engine operating speeds, paddle 64 pivots along with lever arm 65 about pivot 68 in an arc to the positions shown in phantom lines in FIG. 15. This pivoting action causes movement of link arm 56 that pivots choke lever arm 58 to thereby substantially open choke valve 61 at engine operating speeds so that choke valve 61 does not impede the inlet air entering the carburetor throat.

This third embodiment further includes a thermally-responsive plate 69, that causes choke valve 61 to be at least partially open when the engine temperature is substantially warm. Plate 69 may be located on support 67 so that it engages arm 65 below pivot 68. When the engine temperature is warm, above a predetermined temperature, plate 69 deforms and actuates lever arm or abutment surface 65 as shown in FIGS. 17 and 18. Actuation of lever arm 65 causes movement of link 56, which pivots choke lever arm 58 and at least partially opens choke valve 61 so that air may enter the carburetor during hot restarts of the engine.

FIGS. 19 through 23 depict a fourth embodiment of the present invention. In FIG. 19, the engine includes a blower housing 70, and a rewind starter 72 having a pull rope handle 74. The rotatable fan is disposed within blower housing 70. One side of blower housing 70 has an aperture 76 therein. An air vane 78 is pivotally attached to housing 70 at a pivot 80. Air vane 78 includes two opposed sidewalls 82 and 84 (shown in FIG. 21), which are connected by an intermediate wall 86, and a link arm 88 that is pivotally connected to intermediate wall 86 at a pivot 90. Link arm 88 is in turn pivotally connected to a choke lever arm 92, which in turn is connected to a choke valve 94. Further, a thermally-responsive plate 95 is mounted on housing 70 near the bottom of aperture 76.

The embodiment of FIGS. 19 through 23 operates in the following manner. The rotation of fan 20 within housing 70 creates an air flow in housing 70, part of which impinges upon intermediate wall 86 to pivot wall 86 and sidewalls 82 and 84 about pivot 80. Sidewalls 82 and 84 direct the air flow to impinge upon intermediate wall 86 by preventing the air flow from escaping to the sides of intermediate wall 86. When the air flow is below a predetermined level and the engine is cold, such as when the engine is at rest or at engine starting, choke valve 94 is in a substantially closed position. As the air flow increases, the choke valve is rotated to an increasingly open position, so that the choke valve is fully open at engine operating speeds.

Since it is desirable to have the choke valve open for warm engine restarts, thermally-responsive plate 95 is included. See FIGS. 20 through 23. When the engine temperature is substantially at or above a predetermined level, plate 95 deforms. If the engine is at rest but the engine temperature is substantially at or above the temperature of deformation for plate 95, plate 95 deforms and engages intermediate wall or abutment surface 86 to position wall 86 away from aperture 76. This positioning of wall 86 causes link 88 to move, which in turn pivots lever arm 92 to at least partially open choke valve 94. The location of plate 95 is not critical in the design. Plate 95 may be located anywhere so that it abuts an abutment surface and engages and positions wall 86 away from aperture 76 in response to the engine being above a predetermined temperature. Plate 95 may also be located so that it engages at least one of sidewalls or abutment surfaces 82 or 84 and intermediate wall 86.

FIGS. 24 through 27 depict a fifth embodiment of the present invention with yet another thermally-responsive device. As shown in FIGS. 25 and 26, the thermally-responsive device 104 includes elongated housing 106 having a chamber 108 therein. Housing 106 is affixed to vane 28.

A member 110 comprised of a thermal actuating material is disposed within chamber 108. Member 110 has an end 112 that extends out of housing 106, with end 112 abutting an abutment surface 114 that is affixed to the engine.

Member 110 is made from a material which expands when heated to a desired temperature. As a result of the expansion, the elongation of member 110 causes end 112 to abut surface 114, thereby moving vane 28 and keeping the choke valve in a partially open position during hot restarts of the engine.

Several materials may be suitable for member 110. Once such material is available from Hoechst Celanese Corporation of Summit, N.J. and is sold under the trade name HOECHST ACTUATING POLYMERS. The specifications for this material are disclosed in a publication called "Hoechst Actuating Polymers-Material Performance Data" published by Hoechst Celanese at least as early as April, 1996 and incorporated by reference herein. Other suitable materials are high density polyethylene and a nylon material sold under the trademark DELRIN available from E.I. Dupont, Wilmington, Del.

Still other polymers which expand at a temperature that may be suitable for use with the invention are described in a paper by Jang, B. Z. and Zhang, Z. J. entitled "Thermally-End Phase Transformation - Induced Volume Changes of Polymers for Actuator Applications," published in the *Proceedings of the Second International Conference on Intelligent Materials*, Technomic Publishing Company, Inc., June, 1994, pgs. 654–664 and incorporated by reference herein.

Another suitable thermally-responsive device is a wax actuator commercially available from either Caltherm Corporation of Bloomfield Hills, Mich.; Standard-Thompson of Waltham, Mass.; or from Robertshaw Company sold under the trademark POWER PILL. U.S. Pat. No. 5,025,627 issued Jun. 25, 1991, U.S. Pat. No. 5,177,969 issued Jan. 12, 1993, and U.S. Pat. No. 5,419,133 issued May 30, 1995 all described wax-filled actuators which may be used with the present invention and are incorporated by reference herein. In the event that a wax or a gel material is used, it may need to be encased.

FIGS. 28 through 30 depict a sixth embodiment of the present invention with yet another thermally-responsive device. The thermally-responsive device 120 includes a housing 122 having a chamber 124 therein. Chamber 124 contains a thermally actuating polymer, or a thermally-responsive wax or gel member 125 such as those described above. Chamber 124 also contains portions of a piston 126. Piston 126 comprises a first end 128 substantially contained within housing 122, and a shaft 130 which slides through a wall of housing 122 and connects to a second end 132 located substantially outside of housing 122. Housing 122 is affixed to the engine and is located adjacent to lever arm 34. When the engine temperature is below a predetermined level, member 125 is contracted as shown in FIG. 29. When the engine temperature is above a predetermined level, member 125 expands, as shown in FIG. 30. Expanded member 125 pushes first end 128 of piston 126. First end 128 of piston 126 causes shaft 130 to move through a shaft aperture in housing 126. The movement of shaft 130 causes second end 132 to move, then engage and actuate lever arm or abutment surface 34. Actuation of lever arm 34 causes link 36 to move, causing choke lever 38 to pivot about pin 42 and partially open choke valve 40.

FIGS. 31 through 35 depict another embodiment of the present invention with yet another thermally responsive device. The thermally-responsive device 140 includes a device housing 142 having two ends 144, 146, and a chamber 148 therein. Chamber 148 contains a thermally-responsive member 150 which may be a thermally actuating polymer, or a thermally-responsive wax or gel material such as those described above. Thermally-responsive member 150 is fixedly attached within device housing 142 at end 144. Thermally-responsive member 150 has an end 152 that extends out of end 146 of device housing 142, with end 152 of thermally responsive member 150 abutting thermally responsive lever 151.

Device housing 142 is interconnected with engine 10 and is located either under engine blower housing 70 (as illustrated in FIG. 31), or outside engine blower housing 70 adjacent to the engine cylinder. Placing housing 142 under the blower housing will conserve space, whereas placing housing 142 adjacent the cylinder head may provide a more accurate indication of engine temperature. See FIG. 32. Device housing 142 is interconnected with engine 10 by first and second clamps 154, 156. First clamp 154 is rigidly attached to engine 10, and in slidable communication with device housing 142. Second clamp 156 is rigidly attached to device housing 142, and is interconnected to engine 10 by a fastener 158 in a slot 160 provided in second clamp 156.

In the configurations depicted in FIGS. 31–35, thermally responsive lever 151 provides the abutment surface. Thermally responsive lever 151 is fixed to shaft 42, which in turn is fixed to choke valve 40 such that movement of the thermally responsive lever 151 causes rotation of both the shaft 42 and choke valve 40. Thermally responsive device 140 can be positioned with respect to thermally responsive lever 151 by loosening fastener 158, and sliding second clamp 156 relative to fastener 158 in slot 160 until the desired position is reached. Then fastener 158 may be tightened to secure second clamp 156 in place, thereby rigidly securing device housing 142 with respect to engine 10. As second clamp 156 is adjusted, thermally responsive device 140 is allowed to slide with respect to first clamp 154 so that bending or otherwise deforming thermally responsive device 140 is not required. This feature allows the thermally responsive device 140 to be calibrated to the particular engine 10.

When engine 10 is stopped, and the engine temperature is below a predetermined level, member 150 is contracted, thermally responsive lever 151 is in a first position, and choke valve 40 is in a closed position as shown in FIGS. 31 and 32. When engine 10 is stopped, and the engine temperature is above a predetermined level, member 150 expands and abuts thermally responsive lever 151, causing thermally responsive lever 151 to move to a second position shown in broken lines in FIG. 33, and thereby causing shaft 42 and choke valve 40 to pivot to a partially open position (not illustrated).

While several embodiments of the present invention have been shown and described, alternate embodiments will be apparent to those skilled in the art and are within the intended scope of the present invention. Therefore, the invention is to be limited only by the following claims.

What is claimed is:

1. An automatic choke apparatus that increases the startability of an internal combustion engine, comprising:

a device that creates an air flow as a function of the speed of the engine;

a vane that is movable in response to said air flow;

a choke valve disposed in a carburetor throat;

a linkage interconnected between said vane and said choke valve and responsive to the movement of said vane;

an abutment surface interconnected with one of the engine and the vane;

a thermally-responsive device that engages said abutment surface during engine starting when the temperature near said thermally-responsive device is above a predetermined level, to thereby retain said choke valve in a partially open position during engine starting, wherein said thermally-responsive device includes:

a housing interconnected with the other of said engine and said vane, said housing having a chamber therein;

a thermally-responsive member having at least one of a high coefficient of thermal expansion and of thermal contraction, that is disposed in said chamber and that at least one of expands and contracts along its length when the temperature near said thermally-responsive member reaches said predetermined level; and a reciprocable member having a first end disposed within said housing that engages said thermally-responsive member, and having a second end substantially outside of said housing that engages said abutment surface.

2. The apparatus of claim 1, wherein said reciprocable member includes a piston.

3. The apparatus of claim 1, wherein said housing includes an aperture, and wherein said reciprocable member includes a shaft, interconnected between said first end and said second end, that moves in said aperture.

4. The apparatus of claim 1, wherein said air flow creating device includes a radial fan.

5. The apparatus of claim 4, wherein said vane is positioned such that said vane moves radially with respect to an axis of rotation of said fan in response to an air flow created by said fan.

6. The apparatus of claim 1, wherein said vane has a paddle shaped like a segmented cylinder.

7. The apparatus of claim 1, wherein said linkage includes:

a lever arm interconnected with said vane; and a link arm interconnected between said lever arm and said choke valve.

8. The apparatus of claim 1, wherein said housing is interconnected with the engine, and said abutment surface includes a surface on said linkage.

9. The apparatus of claim 1, wherein said thermally-responsive member includes a material selected from the group consisting of a thermally-responsive polymer, a thermally-responsive wax, and a thermally-responsive gel.

* * * * *